United States Patent [19]

Yount

[11] 4,302,048

[45] Nov. 24, 1981

[54] OCCASIONAL CHAIR

[76] Inventor: Velma Ann M. Yount, Rural Box 362-2, Denton, Tex. 76201

[21] Appl. No.: 104,664

[22] Filed: Dec. 17, 1979

[51] Int. Cl.[3] ..... A47C 7/00

[52] U.S. Cl. ..... 297/440

[58] Field of Search ..... 297/440, 441, 445

[56] References Cited

U.S. PATENT DOCUMENTS

| | | | |
|---|---|---|---|
| 2,364,452 | 12/1944 | Kramer | 297/440 X |
| 3,138,401 | 6/1964 | McLean | 297/441 X |
| 3,379,474 | 4/1968 | Schwarz, Jr. | 297/441 X |
| 3,856,345 | 12/1974 | Beckley | 297/440 X |
| 4,062,589 | 12/1977 | Klein et al. | 297/440 X |
| 4,074,919 | 2/1978 | Watts | 297/440 X |
| 4,141,584 | 2/1979 | Cook, Jr. | 297/440 X |

*Primary Examiner*—Francis K. Zugel
*Attorney, Agent, or Firm*—Robert C. Lucke

[57] ABSTRACT

A collapsible chair made primarily of canvas and hardwood made up of two sides each having an arm, a front and a back leg, and a bottom connecting member between the front and the back legs. Canvas seat and back are mounted in grooves in each of the two sides with stretcher means to enable assembly of the sides, seat and back means to be a very comfortable occasional chair. In assembly, the back stretcher means must be inserted before the stretchers for the front and the bottom connecting member. In disassembly, the front and bottom stretchers must be knocked out before the back stretcher can be removed after moving the front legs towards each other.

1 Claim, 8 Drawing Figures

OCCASIONAL CHAIR

RELATED PATENT APPLICATION

A design patent application Ser. No. 104,663 filed Dec. 17, 1979, for OCCASIONAL CHAIR by Velma Ann McCollum Yount is copending.

BACKGROUND OF THE INVENTION

This invention is directed to an improved occasional chair, and more specifically, to a chair which is collapsible and can be stored in a minimum space. Former collapsible chairs were constructed of pivoted elements that were twisted askew in order to be collapsed after the removal of a stretcher means as shown in U.S. Pat. No. 517,656 issued Apr. 3, 1894 to Samuel B. McCullough; constructed with mortice joints as in U.S. Pat. No. 2,427,832 issued Sept. 23, 1947 to Bela Berger; provided with folding stretcher means as in U.S. Pat. No. 3,228,724 issued Jan. 11, 1966 to Herbert R. Resar; constructed of joined tubing means as in U.S. Pat. No. 3,695,702 issued Oct. 3, 1972 to Joseph F. Ingellis; and constructed of tubing and rod stretcher means as in U.S. Pat. No. 4,049,314 issued Sept. 20, 1977 to Andrew W. McGaffin. Lacking was a comfortable collapsible chair of tasteful design which would conform to the variations of the human characteristics of the users, be fully portable, be capable of being stored in a small area, be exceptionally strong, and be relatively easily manufactured.

An object of this invention is to provide a collapsible chair that is comfortable, easily assembled, adaptable to all body shapes including human deformities, fully portable, stored in a small area, exceptionally strong, and is fully functional while being decoratively attractive.

Another object is to provide a collapsible chair that is devoid of stress points that, in previous chairs, caused blood circulation problems in some users.

Still another object of this invention is to provide a configuration of parts for minimum crating wherein the shipping box is of minimal dimensions.

A still further object of this invention is to provide an occasional chair with no metal therein whereby rust, corrosion and other upkeep problems would be eliminated.

Another object is to provide a collapsible chair that lends itself readily to mass production techniques since most of the wooden pieces are of the same dimensions, and since pairs of near identical parts are utilized.

SUMMARY OF THE INVENTION

The chair of this invention is constructed of: side members which included the arms and legs, seat support rails, and a pair of brace members all in hardwood; back and seat means of sheet material; and three stretcher means to secure the assembly in an operative manner. The stretcher means extended between the side members at strategic locations to maintain the assembled condition of the chair. Removal of the stretcher means provides for the collapsible capability of the chair.

BRIEF DESCRIPTION OF THE DRAWINGS

The invention is illustrated by way of example in the accompanying drawing which forms part of this application and in which like numerals represent like parts throughout the several figures in which.

DETAILED DESCRIPTION OF THE INVENTION

Figure 1:
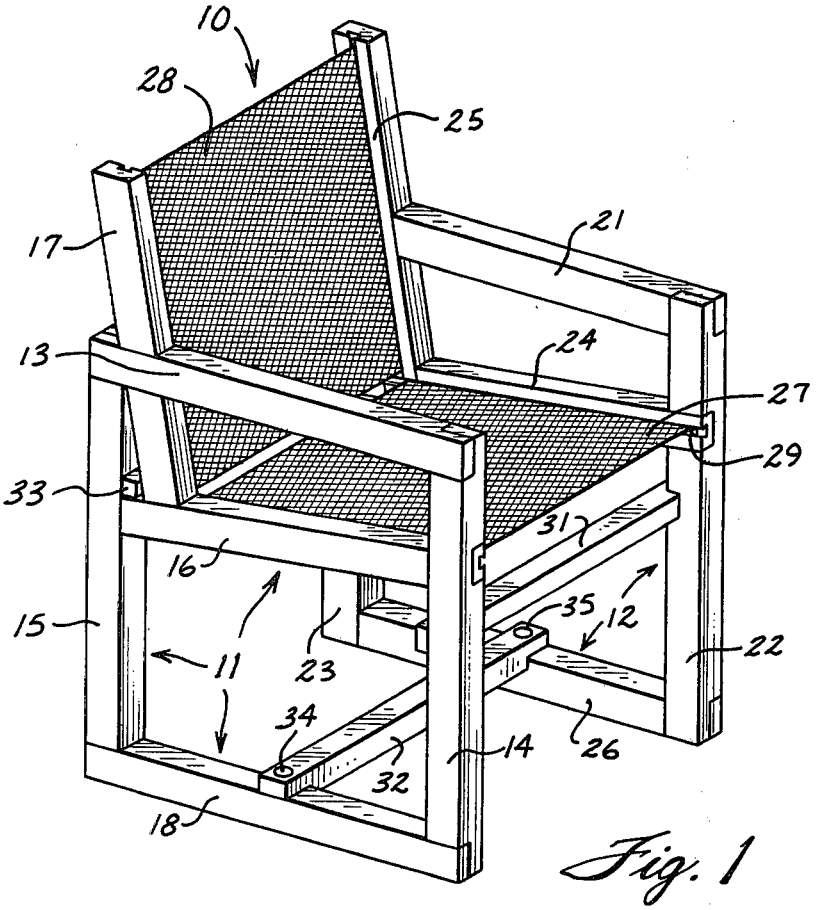
FIG. 1 is a perspective view of the assembled chair of this invention.

Chair 10 has as two of its unified parts left side brace 11 and right side brace 12, which are mirror reflections of each other. Left side brace 11 is made up of left arm 13, left front leg 14, left back leg 15, left seat rail 16, left back rail 17, and left leg brace 16 secured to the bottoms of legs 14 and 15. The right side brace 12 is made up of right arm 21, right front leg 22, right back leg 23, right seat rail 24, right back rail 25 and right leg brace 26 secured to the bottoms of legs 22 and 23.

The chair further has a fabric seat 27 and a fabric back 28. Seat 27 is secured to the seat rails 16 and 24 at opposite ends there of with dowel means, such as shown by dowel 29 as shown in right seal rail 24 in FIG. 1.

To complete the structure of the chair, three stretcher rails are provided; namely, front stretcher rail 31, bottom stretcher 32 and back stretcher rail 33.

In the completely assembled chair as shown in FIG. 1, the right and left side braces 12 and 11, respectively, support the flexible fabric seat and back, 27 and 28, respectively, while the three stretchers 31, 32, and 33 provide the rigidity which opposes the inward forces produced by a person sitting on the seat 27. Dowel means in each of the ends of the three stretchers 31, 32, and 33, such as dowels 34 and 35, shown in bottom stretcher 32 in FIG. 1, provide compensation for the torque forces in the chair structure to eliminate the effects thereof.

Figure 2:
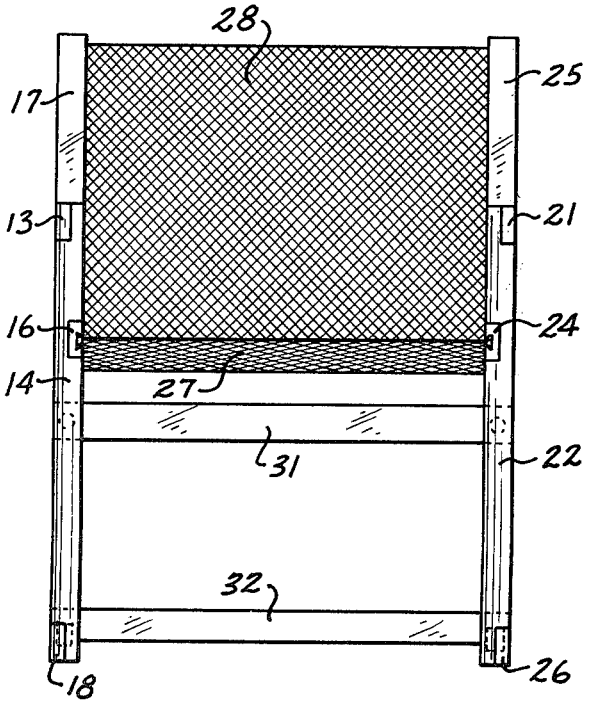
FIG. 2 is a front view of the chair shown in FIG. 1.

FIG. 2 is a front view of the assembled chair wherein stretchers 31 and 32 are shown to be supportive of the front legs and to maintain the proper separation of the bottom leg braces. Also, it is to be noticed that the leg 22 is joined to arm 21, seat rail 24 and leg brace rail 26 in mortice and tenon junctions. The same mode of connection is utilized for the junctions of leg 14 with arm 13, seat rail 6 and brace rail 18. Seat 27 and back 28 are shown in their stretched, assembled condition.

Figure 3:
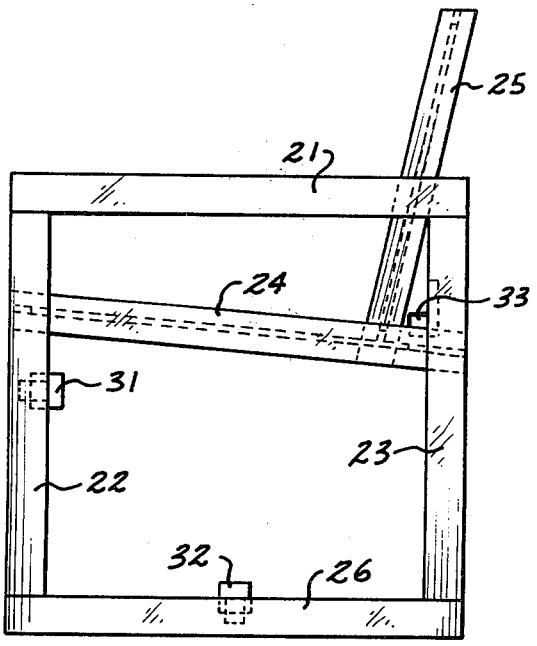
FIG. 3 is a view of the right side of the chair shown in FIG. 1.

FIG. 3 shows a side view of the chair with one end of stretcher 33 being positioned on the seat rail 24 in the space between seat back rail 25 and leg 23. The notched stretchers are shown with the protruding part thereof in place on the back of the leg 22 and on top of the leg brace rail 26. It is to be noted that the angles formed by seat 24 and the back 25 and the side braces provide maximum comfort. It has been determined by others that the greatest comfort derived from the sitting position is derived by having the knees slightly higher than the hips. For this reason, the angle formed by the seat 24 and the leg 23 and the angle formed by the back 25 and the leg 23 was chosen. This angle combination causes the body to lean back slightly with the knees slightly elevated with respect to the hips in a natural, relaxed position.

Since the fabric is the only material in contact with the chair user, there are no stress points to interfere with blood circulation. No part of the wood structure is in contact with the human body except the arm rests.

Figure 4:
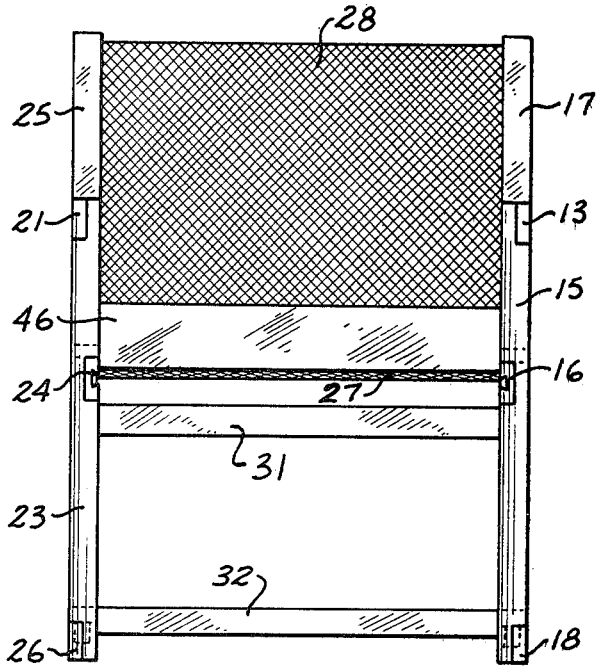
FIG. 4 is a back view of the chair shown in FIG. 1.

FIG. 4 is a back view showing the added structure 46 to stretcher 33 to assure sufficient strength to the chair where the greatest stresses exist.

Figure 5:
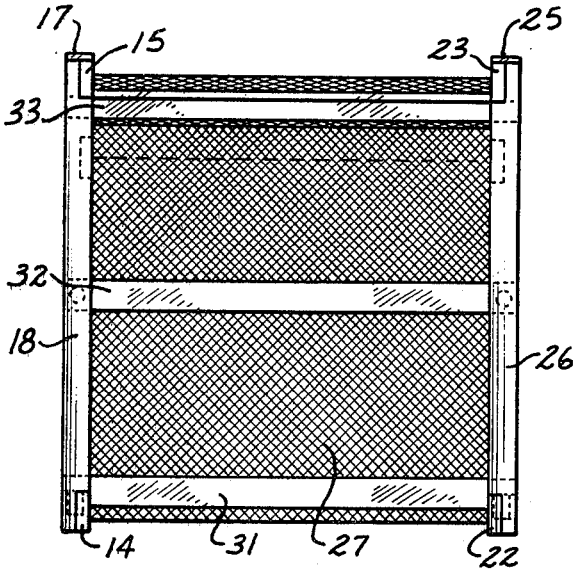
FIG. 5 is a top view of the chair shown in FIG. 1.

FIG. 5 is a bottom view of the chair showing the relationship of the three stretchers to the side braces.

Figure 6:
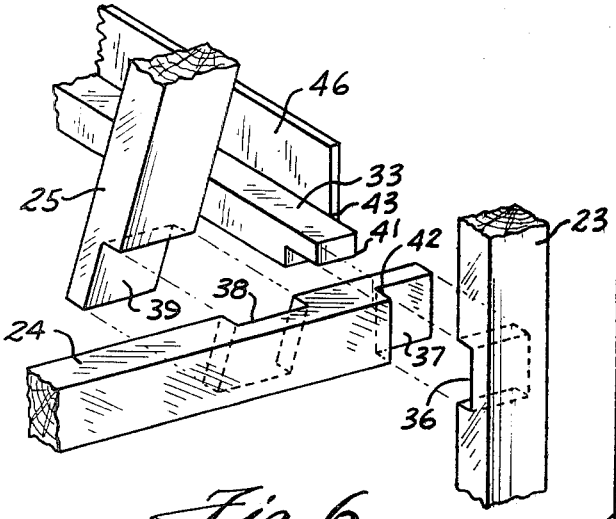
FIG. 6 is an exploded view of the junction of the back leg, seat rail, back rail, and the back stretcher.

FIG. 6 is an exploded view showing the tenon and mortice junctions utilized at the joining of leg 23, seat rail 24, back rail 25 with stretcher 33 entered therebetween. Mortice 36 in leg 23 receives tenon 37 in seat rail 24. Mortice 38 in seat rail 24 receives tenon 39 in back rail 25. Extension 41 of back stretcher 33 rests on surface 42 on top of seat rail 24. Abutment 43 rests against the inner side of seat rail 24.

It is to be noted that back stretcher rail 33 as shown in FIGS. 4 and 6 has no dowels in the ends thereof but does include an additional brace member 46 secured to the back surface thereof and extending upwardly therefrom. Brace member 46 is secured to back stretcher rail 33 by adhesive means or any other appropriate securing means.

Figure 7:
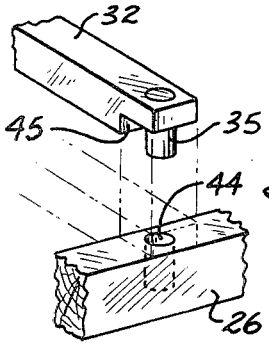
FIG. 7 is an exploded view of the junction of the other stretchers to the leg or brace members.

FIG. 7 shows a leg brace 26 with a hole 44 to receive dowel 35 which is in the notched end of stretcher 32. Surface 45, which is the end resulting from the notching of stretcher 32 for the extension thereof, abuts the inner side of leg brace 26. Dowel 35 fits snugly into hole 44 and surface 45 fits snugly against leg brace 26. Both ends of stretcher 32 and front stretcher rail 31 are provided with dowels as shown in FIG. 7.

Figure 8:
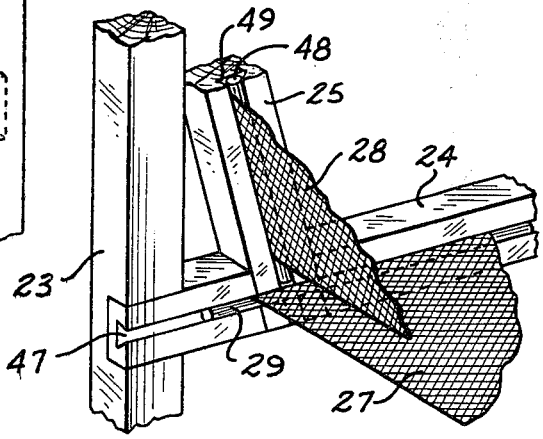
FIG. 8 shows the securing means of the sheet material to the wooden frame as employed for the seat and back.

FIG. 8 illustrates how the seat and back fabrics are secured to the seat and back rails, respectively. A groove 47 in seat rail 24 receives the seat fabric wrapped around a dowel 29. The dovetail shaped groove 47 provides gripping action for a coarse fabric, such as canvas, denim, leather, or the like, around the dowel sufficiently to retain the fabric in the groove without need for hemming the fabric to provide a loop for the dowel to be inserted thereinto. The other end of the fabric is likewise secured to the seat rail 16. The fabric for the back of the chair, however, must be hemmed or otherwise provide a loop structure to secure the fabric around the dowel 48 since the securing forces thereupon are not adequate to retain the fabric within the dovetail shaped groove 49 in back rail 25. The other end of the fabric is likewise secured to the back rail 17. Obviously, smooth fabrics such as velour or the like would require hemmed loops for securing purposes.

Since assembly of the chair is accomplished by separating the two side members, with the seat and back fabrics installed, and placing the three stretcher members in place, disassembly is accomplished by reversing the procedure. The front and bottom stretchers are knocked out by blows by the palm of the hand, the front legs are drawn towards each other to form a triangular shape which spreads the back legs so that, upon rotating the back stretcher 33 ninety degrees enables one end thereof to clear its nearby leg, and then complete removal of the back stretcher is accomplished by sliding it from in front of the other of said two back legs. The two side members are then moved towards each other, the seat and back are folded and the two side members are moved together. The three stretchers are then placed such that the two identical ones are placed on the extension 46 next to the basic stretcher 33 to form a box-like configuration. This can be carried separately from the chair or can be stored in the space provided between the legs and the leg base rails 18 and 26. The container for the complete chair need only be large enough for the end frame members and only as thick as the two said end frame members. Minimal storage space is required.

The choices of material are limited only by the requirements of sufficient strength, proper rigidity for the solid parts and esthetics of the user. The wood can be oak, walnut, birch, ash or the like. The fabric can be canvas, denim, leather, or the like.

It should be understood that the invention is not limited to the exact details of construction shown and described herein for obvious modifications will occur to persons skilled in the art.

The following is claimed:

1. A article of supporting furniture, comprising:

two side members, a rectangular fabric seat means, a rectangular fabric back means, and three stretcher means; whereby a rigid chair is provided when said stretcher means are secured to said side members and whereby a collapsed chair is provided upon the selected removal of the stretcher means from said side members;

said two side members, each comprising:

a front leg means having a first and a second end and a first connecting point intermediate said first and second ends, a back leg means having a third and a fourth end and a second connecting point intermediate said third and fourth ends, an arm means having a fifth and a sixth end;

a brace rail means having a seventh and an eight end, a seat rail means having a ninth and a tenth end and a third connecting point adjacent said tenth end and a back rail means having an eleventh and a twelfth end;

means for connecting said first end rigidly to said fifth end, means for connecting said third end rigidly to said sixth end, means for connecting said second end rigidly to said seventh end, means for connecting said fourth end rigidly to said eight end, means for connecting said ninth end rigidly to said first point, means for connecting said tenth end rigidly to said second point, means for connecting said eleventh end rigidly to said third point, means for connecting one end of said rectangular fabric seat means into said seat rail means intermediate said ninth and tenth ends in one of said two side members, means for connecting an end opposite said last said one end of said rectangular fabric seat means into said seat rail means of the other of said two side members, and means for connecting one end of said rectangular fabric back means into said back rail means intermediate said eleventh and twelfth ends in one of said two side members, and means for connecting an end opposite said last said one end of said rectangular fabric back means into said back rail of the other of said two side members;

said three stretcher means comprising:

a front, a bottom and a back stretcher means, said front and bottom stretcher means being elongated brace members having butt means at each end thereof with tenon extensions therefrom, a securing element for each of said tenon means extending perpendicularly thereto to oppose tensive forces between said side members, and said butt ends of each of said brace members oppose compressive forces thereon, and said back stretcher means having an elongated brace member having butt means at each end with tenon extensions therefrom, front socket means on said front legs means for receiving said front stretcher means securing elements intermediate said seat rail means and said bottom rail means, bottom socket means on said bottom rail means for receiving said bottom stretcher means securing elements intermediate said front and said back leg means, and aperture means defined by the front of said back leg means, the top of said seat rail means, and the back of said seat back rail means for securing said tenon extensions of said back stretcher means.

* * * * *